United States Patent [19]

Dietrich

[11] 4,150,473

[45] Apr. 24, 1979

[54] METHOD TO PRODUCE AN ANCHOR ON A TENDON TWISTED OF SEVERAL STEEL WIRES

[75] Inventor: Hans Dietrich, Bolligen, Switzerland

[73] Assignee: Losinger AG, Bern, Switzerland

[21] Appl. No.: 801,732

[22] Filed: May 31, 1977

Related U.S. Application Data

[62] Division of Ser. No. 645,993, Jan. 2, 1976.

[30] Foreign Application Priority Data

Nov. 21, 1975 [CH] Switzerland ..... 15141/75

[51] Int. Cl.[2] ..... B23P 25/00

[52] U.S. Cl. ..... 29/461

[58] Field of Search ..... 72/295, 302, 305, 308; 29/461

[56] References Cited

U.S. PATENT DOCUMENTS

| | | | |
|---|---|---|---|
| 2,177,567 | 10/1939 | Imbault | 29/461 |
| 2,389,951 | 11/1945 | Brickman | 29/461 |

*Primary Examiner*—Michael J. Keenan

*Attorney, Agent, or Firm*—Oldham, Oldham, Hudak & Weber

[57] ABSTRACT

An anchor on a tendon twisted of a number of steel wires has at least one double-cone widening, the biggest diameter of which is at least three times bigger than the diameter of the unfanned tendon part. The method for producing the anchor comprises seizing the tendon on two spaced apart places and bulging it between these places to form a widening. On the frame of the device for carrying out the above method there are provided two means for seizing the tendon on two places spaced apart whereby one of the means is actuated to exert an axial load on the tendon.

2 Claims, 7 Drawing Figures

METHOD TO PRODUCE AN ANCHOR ON A TENDON TWISTED OF SEVERAL STEEL WIRES

Figure 1:
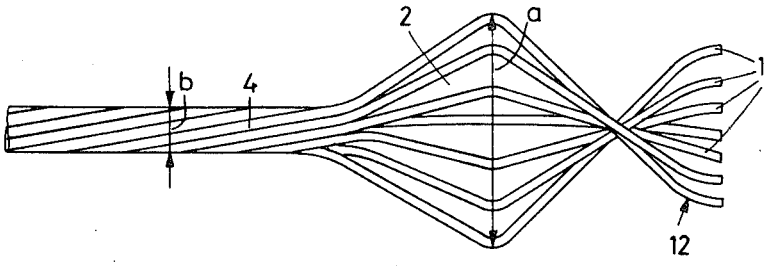

This is a divisional application from prior application Ser. No. 645,993, filed Jan. 2, 1976.

The invention relates to an anchor on a tendon twisted of a number of steel wires which anchor is intended to be anchored in a hardening agent capable of being poured as well as a method for producing the same. The invention relates further to a device for carrying out the method and the application of the anchor.

In structures made especially out of concrete there are anchored steel inserts of rods, wires, wire coils or cables. This will be done either by means of anchoring bodies especially built for the purpose which are fastened on one hand to the steel inserts to be anchored, and on the other hand they are supported by the flat surfce of the concrete, or by directly utilizing the shear bond between the steel inserts and the concrete. In order to keep the bond length over which it can be reckoned with a sure introduction of the force to be anchored in the concrete as short as possible special measures have to be taken. So the steel rods are provided with a special profile which serves for strengthening the bond effect. The deforming of individual wires in waves serves the same purpose. The end parts of the steel inserts are often provided with hook spirals, loops in order to obtain a reliable anchoring of the same.

There are special problems with the anchoring of tendons of twisted high-strength steel wires. On one hand it is important to anchor very high forces with very small cross-sectional areas and accordingly also with smaller surfaces, whereas on the other hand the above-mentioned measures are usually not of any use. A method in which the tendons are opened (untwisted) at their ends and provided therewith a round insert by means of which a local widening of the tendon can be achieved, is known; however, in such a method the energy consumption is very high and the space opened by spreading the tendon is quite small.

It is an object of the invention to provide an anchor on a tendon which corresponds to the structural conditions of the tendon and by means of which a reliable, pressure locking anchoring in a hardening agent capable of being poured is achieved. Another object of the invention is to propose a method and a device for producing such an anchor by means of which the anchor on a tendon can be produced in a very simple way without using complicated equipment. The anchor according to the invention is characterized by at least one double-cone widening formed by the fanned tendon wires spaced apart from one another, the biggest diameter of which being three times up to fifteen times bigger than the diameter of the unfanned tendon part.

By pushing the individual wires of the tendon into a double-cone widening of the wire coil there is provided a sufficiently big space which will be filled with concrete. The concrete has in this case the function of a spacer, as it takes over the reflection forces of the untwisted, widened wires of the tendon. In this way the stability of the complete anchor is secured even if it is under load. When the opposite tendon end is now pulled the widened part of the tendon provides a good support against the pulling force and prevents the tendon from being pulled out of the anchorage.

The method for producing the anchor is characterized in that the tendon is seized on two places spaced from each other and bulged whereby the individual tendon wires buckle and a widening is formed between both said places, the length of the buckling path which is decisive for the size of the biggest diameter of the widening being adjustable as required.

The device according to the invention to carry out the method is characterized by a frame having a press attached to its one side, said press having a first means connected with the press piston for seizing the tendon on one place, and a second means attached to its other side for seizing the tendon on another place spaced from the first one in order to exert an axial load on the tendon passing through said frame and seized by said means by actuating said press.

According to the invention the anchor is applied at least on one of the tendons of a cable twisted out of a number of tendons.

The invention will be made more comprehensible by a drawing in which

Figure 2:
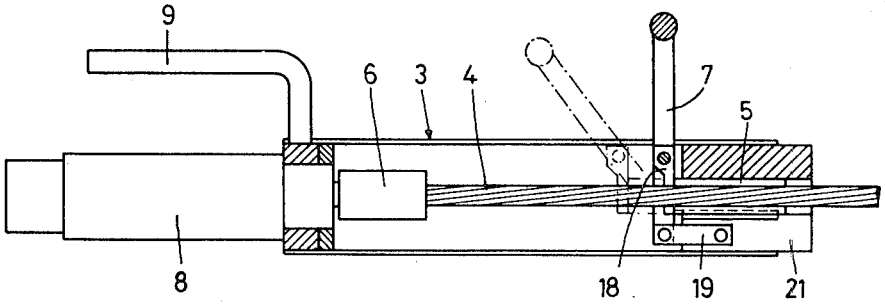
Figure 3:
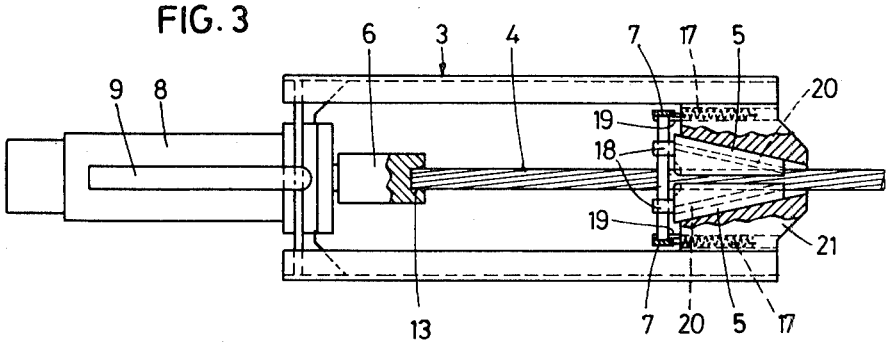
Figure 4:
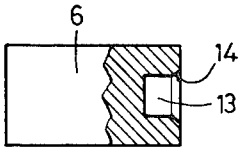
Figure 5:
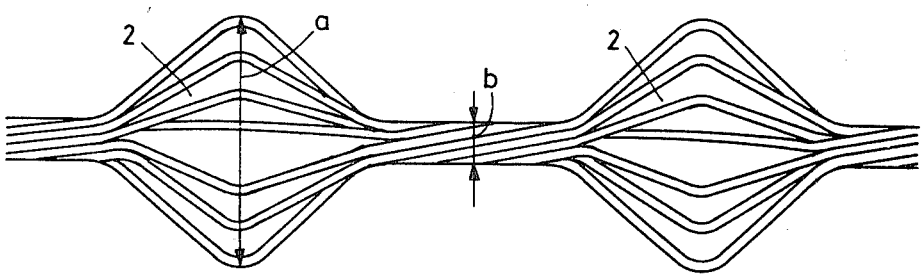
Figure 6:
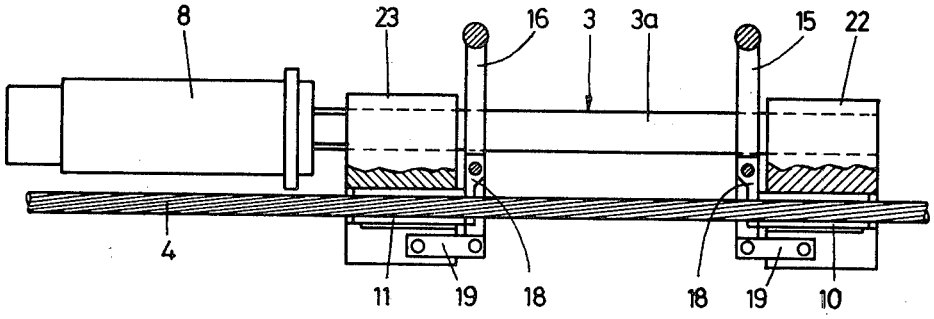
Figure 7:
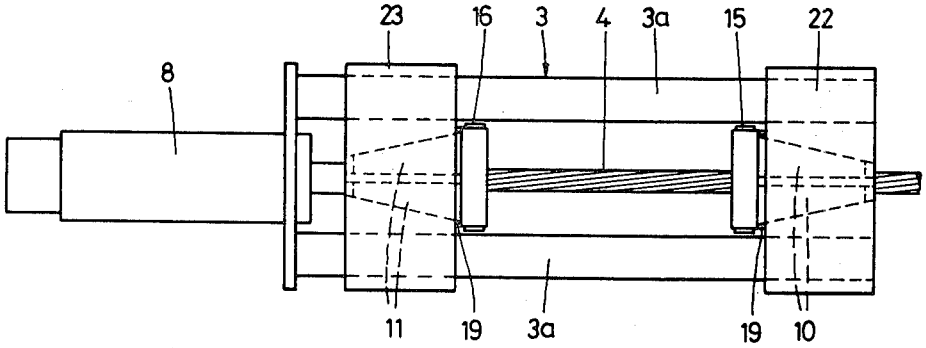

FIG. 1 shows an elevation of an anchor on a tendon twisted of several steel wires in a simple execution, FIG. 2 shows an elevation of a device for producing the anchor according to FIG. 1, partially in section, FIG. 3 shows a plan view of the same, partially in section, FIG. 4 shows an elevation of a headpiece for receiving a tendon end according to FIG. 3, partially broken away, FIG. 5 shows an elevation of an anchor on a tendon having two widenings, FIG. 6 shows an elevation of a device for producing the anchor according to FIG. 2, partially in section, and FIG. 7 shows a plan view of the same, partially in section.

FIG. 1 shows a tendon twisted of several steel wires. There is a double-cone widening on its one end which was caused by bulging the tendon, as it will be explained in detail. By the fanned tendon wires spaced apart from one another a space is surrounded which will be filled with concrete, when the tendon will be anchored because the distances between the individual tendon wires 1 are sufficiently big in the region of this widening to allow the intrusion of the hardening concrete mixture capable of being poured. As it can be seen from the Figure, the end part of the tendon is formed as a fanned end 12 with counterslope which form helps to a better anchorage of the tendon and also to a better carrying capacity thereof.

The biggest diameter a of the widening forming the anchor comprising the fanned tendon wires 1 spaced apart from one another is in the embodiment five times as big as the diameter b of the unfanned tendon part. A good anchoring will also be achieved when the biggest diameter a three times up to fifteen times bigger is than the diameter b of the unfanned tendon part.

The device for producing the anchor according to FIG. 1 is shown in FIG. 2 up to 4. It has a frame 3 to which a hydraulic press 8 is attached. A headpiece 6 arranged inside the frame 3 is connected with the press piston. The headpiece 6 is shown in detail in FIG. 4. It is with advantage a cylindrical body which is connected at its one side with the press piston and which has at its other side a bore 13 the diameter of which equals approximately to the diameter of the tendon. The bore is chamfered or rounded over one fifth up to one third of its depth which is marked with 14. The chamfer 14 guides the tendons to the desired slope when they are bulged, as hereinafter explained. The head-piece 6 serves for receiving the end part of the tendon 4, as it can be seen in details from the FIG. 3. The diameter of the bore 13 is such that it allows a small play of the tendon end in it. The chamfered aperture 14 of the bore 13 is inclined to the longitudinal axis of the bore by approximately 30°. The depth of the bore 13 equals approximately the diameter of the tendon 4.

On the other side of the frame there is attached to the same a counterpart 21 in which a wedge bolt 5 with two clamping jaws is axially movable. A lever 7 actuated by springs 17 serves for clamping the jaws guided in slots 20. The lever 7 pivots in a fish plate 19 and is slidably connected with guide shoes 18 positioned on each clamping jaws. By pushing the lever 7 of the clamping jaws will be clamped on the tendon 4. Each clamping jaw has a chamfered or rounded part facing the headpiece 6 which corresponds with that one 14 of the headpiece 6.

A handle 9 serves for transporting the whole device.

By means of the device according to the FIG. 2 up to 4 an anchor is produced on a tendon as follows: The device will be pushed over the end of the tendon 4 until the tendon end is brought into the bore 13 of the headpiece 6. The clamping jaws of the wedge bolt 5 are clamped on the tendon 4 on a place spaced from the headpiece 6 by pushing the lever 7. By driving out the hydraulically operated press piston the tendon 4 between the headpiece 6 and the wedge bolt 5 will be axially loaded so that the individual wires 1 of the tendon 4 buckle to the side. By adjusting the working stroke of the press the diameter of the anchor can be exactly determined. During the back stroke of the press 8 the tendon 4 is loosened from the headpiece 6, whereby because of the elasticity of the tendon wires the fanned end 12 according to FIG. 1 is formed. The counterslope curving of the anchor is formed by the chamfered aperture 14 of the bore 13.

When the anchoring force of the one tendon widening is not sufficiently great, the anchor can comprise several widenings arranged one after the other as can be seen from FIG. 5.

The device for producing such an anchor as in FIG. 5 is shown in FIGS. 6 and 7. The device has a frame 3 and a press 8 in the same way as the device according to FIGS. 2 to 4. In addition it comprises two wedge bolts 10, 11 having each two clamping jaws positioned eccentrically to the press 8 and to the frame 3. The wedge bolts 10, 11 are axially movable in a counterpart 22 fixed to the frame 3 or in a counterpart 23 movable on a guide bar 3*a* of the frame 3. The remaining parts of the device are the same as with the device according to FIGS. 2 to 4 and include levers 15, 16 like the lever 7. The wedge bolts can be positioned at any place of the tendon 4 so that it is possible to produce the widening also on other places than at the end of the tendon.

When the clamping jaws of the wedge bolt 11 according to FIGS. 6 or 7 are replaced with an insert which is similar to the headpiece 6 according to FIGS. 2 up to 4, it is possible to produce with such a device also a simple widening according to FIG. 1.

The production of the anchors according to FIGS. 1 or 5 by using the above-mentioned devices is very simple and quick and there are low costs involved. By means of these devices the anchor can be produced, at the end or at any other place of the tendon. The above-metioned anchor can be applied on at least one of the tendons of a cable twisted of several tendons.

When the complete tendon is simultaneously anchored only a part of the force will be taken by the anchor in combination with the shear bond of the tendon.

The pulling-out of the tendon of the concrete is prevented by the anchored anchor. While two complete embodiments of the invention have been disclosed herein, it will be appreciated that modification of these particular embodiments of the invention may be resorted to without departing from the scope of the invention.

I claim:

1. Method of producing an anchor on a tendon formed of a number of twisted steel wires intended to be anchored in a hardening agent capable of being poured, including the steps of seizing the tendon by seizing means at two places axially spaced from each other and from the ends of said tendon, providing guide means for the tendon between the seized means and immediately adjacent the seized places thereof, and exerting axially compressive forces on the tendon to bulge the same by moving said two places toward each other to stress the steel wires beyond their yield point at spaced portions thereof, whereby a widening is formed wherein the guide means control the shape of the wires as they are bulged and wherein said axially compressive forces can be exerted over any portion of the tendon to form an anchor of permanently buckled wires having straight sections in the shape of a double-cone.

2. Method of producing an anchor on a tendon formed of a number of twisted steel wires intended to be anchored in a hardening agent capable of being poured, including the steps of confining the tendon at an end thereof, seizing the tendon at a place axially spaced from the end of said tendon but adjacent said end, providing guide means for the tendon between the seized means and confined end and immediately adjacent the seized place and the confined end, and exerting axially compressive forces on the tendon to bulge the same by relative movement of said place in relation to said end whereby a widening is formed wherein the guide means guide wires as they are bulged and the axially inner portion of the confined tendon end is guided to bulge to a conical apex shape, and subsequently releasing the confined tendon end whereby the elasticity of the wires forms a fanned end on the tendon.

* * * * *